US005845619A

United States Patent [19]

Reichlinger

[11] Patent Number: 5,845,619

[45] Date of Patent: Dec. 8, 1998

[54] ENGINE GOVERNOR FOR REPETITIVE LOAD CYCLE APPLICATIONS

[76] Inventor: Gary Reichlinger, 118 W. 8th St. P.O. Box 4, York, Nebr. 68467

[21] Appl. No.: 885,693

[22] Filed: Jun. 30, 1997

[51] Int. Cl.[6] ..... F02D 41/00

[52] U.S. Cl. ..... 123/350; 123/361

[58] Field of Search ..... 123/361, 350, 123/351

[56] References Cited

U.S. PATENT DOCUMENTS

| | | | |
|---|---|---|---|
| 3,974,432 | 8/1976 | Thompson | 318/562 |
| 4,919,096 | 4/1990 | Manaka | 123/399 |
| 4,997,346 | 3/1991 | Bohon | 417/319 |
| 5,212,380 | 5/1993 | Sato | 250/231.17 |
| 5,333,109 | 7/1994 | Oo | 364/426.04 |
| 5,491,632 | 2/1996 | Pawlak et al. | 364/424.05 |
| 5,631,543 | 5/1997 | Watson | 322/27 |

*Primary Examiner*—Erick R. Solis

[57] ABSTRACT

A governor for an internal combustion engine suitable for speed regulation of engines driving loads of such character that the power requirements vary more within a recurring cycle than between such cycles is provided by the current invention. Means are provided for speed detection, designation of a number of fixed positions within the load cycle, setting of a power control to specific positions, and memory to store representations of load cycle positions and engine power control positions. A microprocessor computes an engine power control position at each load cycle position and applies the power control position to the engine by controlling the engine power control means.

12 Claims, 3 Drawing Sheets

ENGINE GOVERNOR FOR REPETITIVE LOAD CYCLE APPLICATIONS

TECHNICAL FIELD

This present invention relates to speed regulation of internal combustion engines employing condition responsive control with electrical sensing and regulating. More particularly, it relates to the speed regulation of engines driving loads of such character that the power requirements vary more within a recurring cycle than between such cycles.

BACKGROUND INFORMATION

Speed governors, originally developed for steam engines, have been used on internal combustion engines since their inception. Mechanical governors employing flyweights to sense the speed and springs to position a throttle are still used on some engines. More recently, electronic governors of many different types have been developed. The established features of the electronic governors include a means to detect the speed of the engine, a digital or analog computational unit, and a means to actuate or control the power control of the engine. The field of speed detection means, or tachometers, is well established and known methods include timing between ignition pulses, timing between pulses generated by external sensors such as Hall-effect types, measurement of voltage or electrical phase produced by small generators engaged to the engine, and other arrangements. The type of power control employed will depend on the type of engine being controlled. Carbureted engines are controlled with a throttle valve which determines the amount of air-fuel mixture available to the engine. Solenoids, stepper motors, and other types of actuators have been used to position the throttle through a variety of linkage designs. Fuel flow is directly controlled in fuel-injected engines. While the technology differs among the various types of governors, there are some basic similarities in the manner in which they operate. The engine speed is sensed and compared to a preselected speed. Often, acceleration may be measured or computed. With this input information, the computational unit uses an analog circuit or digital algorithm to determine an appropriate response and the power controls are adjusted. Time is required for an errant power setting to cause a speed deviation and be detected. Some additional time is spent actually making the adjustment. The intake, compression, and power cycles must then take place before the power change is reflected in engine output. This complete cycle may need to be repeated a few times before a stable power setting is achieved. The total time lag will vary somewhat depending upon the sophistication of the governor and the speed of the engine, but there is still an implicit assumption that the power setting required at a specific point in time is very close to what was needed at a corresponding point in the immediate past.

Some of the loads driven by internal combustion engines are such that the power requirements vary more within a recurring cycle than between such cycles. The driven machinery may be a reciprocating device which has a large power requirement at a point in its operating cycle where it is lifting, pumping, compressing, or compacting something, but a much lower power requirement where a working element is being positioned for the next such action. An oil well pumping unit is a known example of such a device which has had the power requirements at each point in its cycle documented, as in U.S. Pat. No. 4,997,346. The power requirement on these types of loads can change very rapidly within the cycle, but usually does not vary much from a specific point in one cycle to a corresponding point in the next. A sequence meeting these requirements is referred to as a repetitive load cycle.

Many types of position sensors are known in the art. They can be based on switch contact, capacitance, optics, Hall-effect, magneto-resistance, and other effects. Rotary encoders, such as described in U.S. Pat. No. 5,491,632, are designed to designate numerous distinct positions in the rotation of a shaft of a machine or device.

The repetitive load cycle can represent a challenging environment to speed governors. The implicit assumption referred to above that the power requirement is very close to an immediately preceding requirement is simply not very accurate because the actual power requirement is continuously changing. In actual practice, speed regulation is generally poor in these applications. The variation in speed results in increased fuel consumption and greater wear on both the engine and the driven machinery. It may be necessary to use larger engines than would otherwise be the case to compensate for the limitations of the governor. In the oil well pumping unit application, specialized engines with large flywheels are generally used which are much more expensive than standard engines.

SUMMARY OF THE INVENTION

This present invention provides a method and a device for controlling the speed of an internal combustion engine operating with a repetitive load cycle. This is accomplished by adjusting the power control at each point in the load cycle to the same power setting as it was at the corresponding point in the previous cycle plus or minus an adjustment made based on engine speed performance in that previous cycle. Means are provided for designating a number of fixed points within the load cycle. Engine speed detection means and power control means are also provided. Electronic memory is used to store digital representations of the power control positions at corresponding load cycle positions. A microprocessor is used to determine an appropriate adjustment in the power control position for the next cycle and to apply the power control position to the engine by controlling the engine power control means. The term microprocessor is construed to encompass related computational units including microcontrollers, digital signal processors, application-specific integrated circuits, and other types of logic devices.

More specifically, position sensors are used to designate a number of specific positions in the load cycle. A rotary encoder may be attached to the working shaft of the driven machinery. Another approach is to employ one position sensor on the driven machinery at a key point and a separate sensing arrangement on the engine which detects full or partial rotations of the engine. In this manner, the starting point of the load cycle is defined when the sensor on the driven machine is activated and each time the engine-based sensor is activated, a succeeding point is designated until the next pulse of the sensor on the driven machinery. Those skilled in the art of position-sensing or engine-monitoring will recognize that there are many variations possible that can be devised to designate load cycle positions.

A power control for the engine is provided which is capable of being set to specific positions. Depending on the type of engine, the positions could correspond to the extent of opening of a throttle valve or to the rate at which fuel is being injected into the engine.

Memory is used to store the power control position at each load cycle position. This can be accomplished by allocating an area of memory equal to the number of bytes required to store a power control position multiplied by the number of load cycle positions. The power control positions can then be stored consecutively beginning with the position at the first load cycle position and running to the power control position at the last load cycle position. Many modern microcontrollers have enough internal ram memory to accommodate this arrangement, but external memory can be used as well.

The microprocessor interfaces to the speed detection means, the load cycle position sensing or designating means, the power control means, and the memory means. As each new load cycle position is achieved, the microprocessor compares the engine speed with the target engine speed. Acceleration may also be measured or computed. An algorithm is then executed by the microcontroller to determine the amount of adjustment, if any, that needs to be applied to the power control. This adjusted power control position is then stored to be applied to the power control at the corresponding point during the next load cycle.

It is an objective of this invention to provide a governor capable of more accurate speed regulation of internal combustion engines used to drive equipment which experiences repetitive load cycles. It is a further objective of this invention to facilitate the use of standard engines on equipment such as oil well pumping units.

DESCRIPTION OF THE PREFERRED EMBODIMENT

Figure 1:
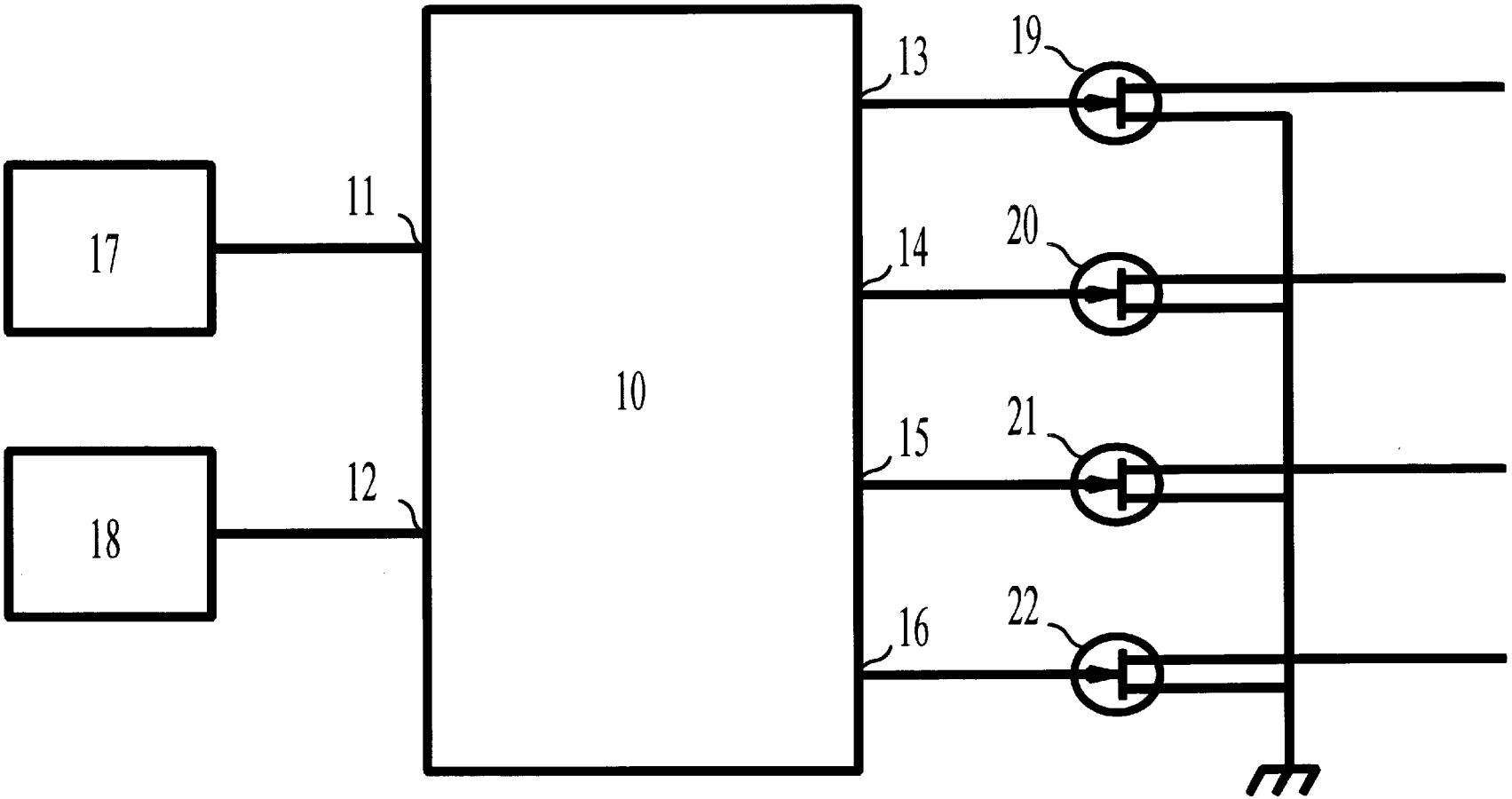
FIG. 1 is a simplified schematic drawing of an electronic circuit which can be used to practice the invention. Included in the circuit is a microcontroller which encompasses microprocessor and memory means. Well-known microcontroller support circuits such as voltage regulators, reset control, timing crystals, and ground connections have been omitted for clarity.
Figure 2:
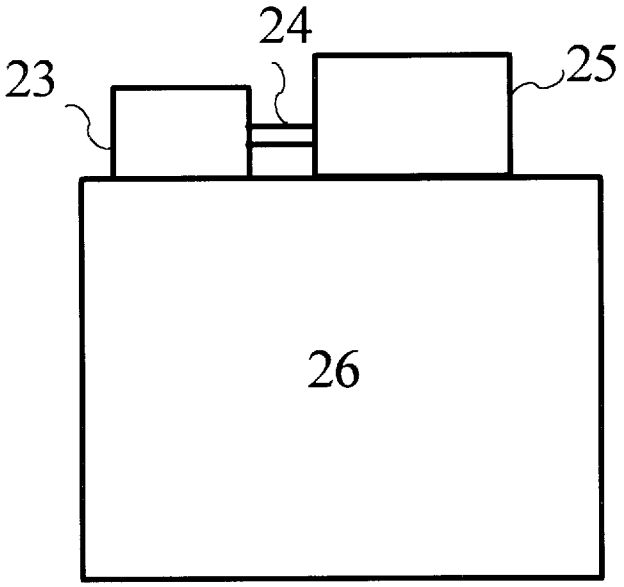
FIG. 2 illustrates a power control means and its relationship to the internal combustion engine in an embodiment of the invention.
Figure 3:
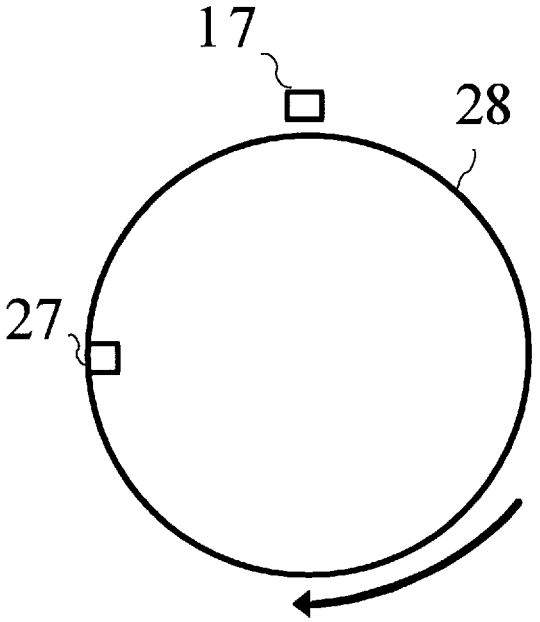
FIG. 3 shows a sensor arrangement used in connection with the speed detection means and also the load cycle position designating means employed in an embodiment of the invention.

Referring more particularly to the drawings, FIGS. 1 through 3 disclose a microcontroller 10 with inputs 11 and 12. Input 11 is connected to a Hall-effect switch 17 mounted near a flywheel 27 of an engine 26. The flywheel 27 has a magnet 28 mounted on it such that the magnet 28 passes near the switch 17 once per revolution of engine 26. Input 12 of microcontroller 10 is connected to a Hall-effect switch 18 which is mounted at a key position on the driven machinery. Microcontroller 10 also has outputs 13 through 16 which are connected respectively to the gates of mosfets 19 through 22. The source connections of mosfets 19 through 22 are grounded. The drains of mosfets 19 thought 22 are connected to the four low-side contacts of a stepper motor 23. Stepper motor 23 through a linkage 24 positions a throttle valve 25 of engine 26.

The engine speed is detected by measuring the time between pulses created by Hall-effect switch 17 on input 11. Many microcontrollers offer the feature of internal pull-up resistors available for input pins. This allows the input to be at a logic high until the attached device is connected to ground to pull it to a logic low. If a selected microcontroller does not offer this feature, it is possible to do it externally by connecting a suitable resistor from the power supply to the input pin. Inputs 11 and 12 are pulled high with an internal pull-up resistor. When Hall-effect switch 17 or 18 is in the presence of a magnetic field, it connects the attached input to ground and thus generates a logic low to the respective input. The Allegro Microsystems A3121LUA is an example of a Hall-effect switch which is suitable for this application. The transition from logic high to logic low on an input then generates an interrupt to microcontroller 10. This interrupt then causes the value of an internal timer of microcontroller 10 to be saved into a register. By subtracting the time value of the previous interrupt, it is possible to compute the time between pulses. The time value then provides the data necessary to compute an engine speed.

The interaction of the pulses from Hall-effect switches 17 and 18 can be used to designate a number of fixed positions within the load cycle. Hall-effect switch 18 has been located on the driven machinery at a point such that an attached magnet passes by it once during the load cycle. It is advantageous to place it where it would indicate a beginning point in the load cycle. In the oil well pumping unit application, it has been found that placing a permanent magnet on one of the counterweights and Hall-effect switch 18 on a bracket at the point where the counterweights are at their lowest point of rotation is a suitable arrangement. However, many other positions and mounting arrangements could be acceptable. When the magnet passes by Hall-effect switch 18, it is activated and accordingly causes input 12 to generate an interrupt to microcontroller 10. This causes a program to be run on the microcontroller which resets a load cycle counter to zero. The next interrupt on input 11, caused by the activation of Halleffect switch 17, then designates the first point in the load cycle. Each time there is another interrupt on input 11, the load cycle counter is incremented and a succeeding point is designated. The next activation of Hall-effect switch 18 starts the cycle over again. In the oil well pumping unit application, a standard engine will typically make 250 to 500 rounds per load cycle and thus define that many points using this method. While many other sensor arrangements can be used, only two low cost Hall-effect switches are needed to implement this embodiment.

Stepper motor 23 is able to set the power control, throttle valve 25, to a number of specific positions. As previously indicated, microcontroller 10 controls stepper motor 23 through its outputs 13 through 16 and mosfets 19 through 22. The use of a sequence of pulses from a microcontroller to control a stepper motor is well known to those skilled in the art of programming microcontrollers. The choice of stepper motors will depend on the engine being used and the linkage chosen. On a number of engines, including a Briggs and Stratton 16 horsepower model, the Haydon Switch and Instrument 26862 stepper motor, which includes an enclosed drive screw, has been found to be satisfactory. Each step of the stepper motor provides a linear movement of 0.002 inches by rotating the drive screw. Since the throttle shaft of the Briggs and Stratton engine has about one-half inch of travel, this provides for about 250 steps. As values ranging from zero to 255 can be stored in one byte of memory, a digital representation of the throttle position can thus be stored in a single byte.

Memory is used to store the position of throttle valve 25, defined in terms of steps of stepper motor 23, at each consecutive value of the load cycle counter. Typically, less than 500 bytes of memory is required so the internal ram of many microcontrollers is sufficient. An area of memory is then allocated for these values with a specific memory address corresponding to the beginning position. Any position in this memory area can then be directly addressed by adding a value of the load cycle counter to this starting address to determine the throttle position at said load cycle counter value. The initial values in memory when the engine is first started can be derived in two different ways. First, if the power requirements of the system are fairly well established, it is possible to just load a set of predetermined starting values directly. This would be used, for example, in situations where the engine was being run at intermittent intervals and the load situation had not changed much from the last time it was run. In the oil well pumping unit application, this would be the situation where the well was being operated for a fixed period of time and then shut down to let fluid accumulate in the well bore. At the start-up, the pumping conditions would be close to those existing at the time of shutdown. If the power requirements were less established, a second method would be used. After the engine is started, it is run through one load cycle during which time the microcontroller controls the engine speed based on a prior art governor algorithm. The speed detection means and the throttle positioning means provide the necessary equipment to accommodate this arrangement. As the load cycle counter is incremented at each pulse generated by Hall-effect switch 18, the current throttle position is then moved into memory and the memory pointer is incremented for the next position. When the load cycle is complete, the memory contains a set of values corresponding to each throttle position at the respective load cycle position which can then be used to practice the method of the current invention. Speed regulation will not be as good during this interval as it would be later, but this does provide some starting values which can then be progressively optimized.

Figure 4:
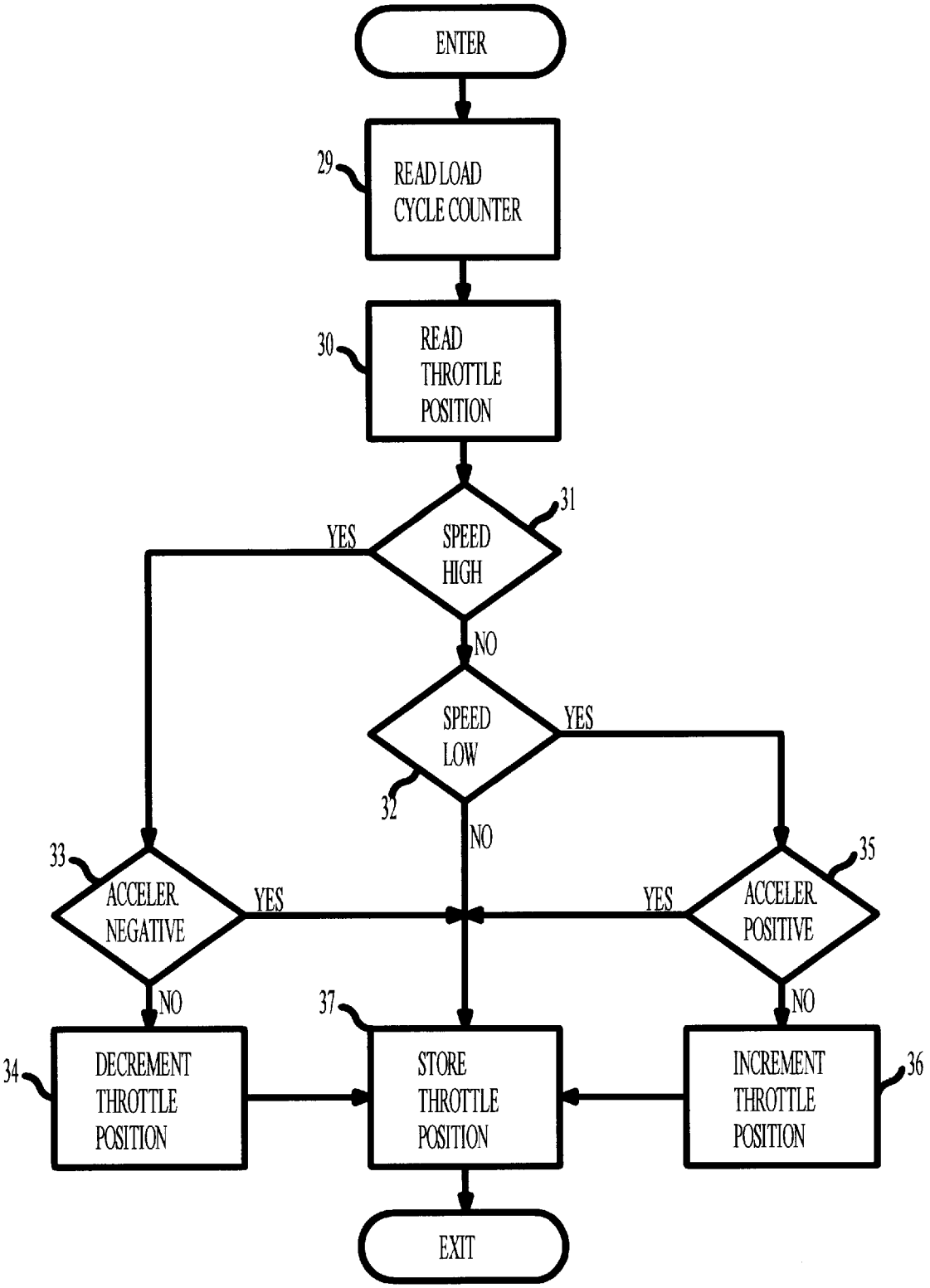
FIG. 4 is a flowchart of the process steps performed by a microprocessor to implement the speed control method of an embodiment of the invention.

Microcontroller 10 computes the throttle position value for each load cycle position and then controls stepper motor 23 to implement it. FIG. 4 illustrates a method of computing the appropriate throttle position. In step 29, the current load cycle counter is read. As indicated above, there is already in memory a throttle position corresponding to each load cycle position. The load cycle counter is then used in addressing a throttle position in step 30. This is computed by adding the load cycle counter value to the beginning memory address. It is useful to then subtract a small offset value from this result prior to addressing the memory position. Since one load cycle position is being defined for each round of the engine, this then gives the opportunity to go back several rounds of the engine from the current time to find a throttle position. The reason this is preferred is that the current speed performance of the engine is a result of the throttle setting at an earlier time. The normal power sequence of a four-cycle engine, throttle positioning time, and speed sensing time, combine with other factors to create a lag time. In step 31, a comparison is made to determine if the engine speed is above the target engine speed. If it is higher, the process proceeds to step 33; otherwise it goes to step 32. Acceleration can be easily computed in this arrangement by subtracting the previous speed from the most recent speed detected. In step 33, if acceleration is negative, the process proceeds to step 34. In step 34, the throttle position value previously read is decremented and then is returned to its original position in memory in step 37. Step 32, which is executed on a negative outcome of step 31, compares the current speed with the target speed. If it is higher, the process proceeds to step 35. If in step 35, acceleration is positive, the throttle position is incremented in step 36. As with the earlier route, step 37 restores the adjusted throttle position to its original place in memory by using the address value computed in step 30. A more stable speed regulation is achieved by considering acceleration as in steps 33 and 35 than would be possible just by considering speed deviation. If the current power setting is causing an over-speed engine to decelerate, the over-speed condition is being caused somewhere else in the load cycle. A change of one throttle position value in steps 34 and 36 is often sufficient for the oil well pumping unit application. Other embodiments may calculate a varying amount of change in these steps based on the amount of speed deviation or rate of acceleration. It is preferred to apply the adjustment computed by this method during the next load cycle. This allows the use of the offset mentioned above to compensate for the inherent lag time in the speed regulation process. The throttle positioning process then consists of reading the throttle position from memory corresponding with the current value of the load cycle counter and then issuing the necessary pulses through outputs 13 through 16 to cause stepper motor 23 to move the throttle to that position.

I claim:

1. A governor to control the speed of an internal combustion engine, which engine has a driven load of such character as to experience a repetitive load cycle, comprising:

a means to detect the speed of the engine;

a means to designate a number of fixed positions within said load cycle;

a means to set a power control of the engine to specific positions;

memory means to store representations of load cycle positions and engine power control positions;

a microprocessor to compute an engine power control position at each load cycle position and to apply said power control position to the engine by controlling the engine power control means.

2. A device according to claim 1 wherein the means to detect the speed of the engine is a microprocessor computing the time between pulses generated by a Hall effect switch which is periodically activated by coming within the field of a permanent magnet mounted on a flywheel of the engine.

3. A device according to claim 1 wherein the means to designate a number of fixed positions in the load cycle is a rotary encoder.

4. A device according to claim 1 wherein the means to designate a number of fixed positions in the load cycle consists of a Hall-effect switch on a flywheel of the engine along with an additional Hall-effect switch mounted on a machine, which machine constitutes the driven load of the engine.

5. A device according to claim 1 wherein the means to set the power control is a stepper motor positioning a throttle valve of the engine.

6. A device according to claim 1 wherein the means to set a power control is a fuel injection system with a variable rate of fuel flow.

7. A governor to control the speed of an internal combustion engine, which engine drives an oilwell pumping unit which has a repetitive load cycle, comprising:

a means to detect the speed of the engine;

a means to designate a number of fixed positions within the load cycle of the pumping unit;

a means to set a power control of the engine to specific positions;

memory means to store representations of load cycle positions and engine power control positions;

a microprocessor to compute an engine power control position at each load cycle position and to apply said power control position to the engine by controlling the engine power control means.

8. A device according to claim 7 wherein the means to detect the speed of the engine is a microprocessor computing the time between pulses generated by a Hall effect switch which is periodically activated by coming within the field of a permanent magnet mounted on a flywheel of the engine.

9. A device according to claim 7 wherein the means to designate a number of fixed positions in the load cycle is a rotary encoder.

10. A device according to claim 7 wherein the means to designate a number of fixed positions in the load cycle consists of a Hall-effect switch on a flywheel of the engine along with an additional Hall-effect switch mounted on the pumping unit.

11. A device according to claim 7 wherein the means to set the power control is a stepper motor positioning a throttle valve of the engine.

12. A device according to claim 7 wherein the means to set a power control is a fuel injection system with a variable rate of fuel flow.

* * * * *